United States Patent [19]

Schmanski

[11] Patent Number: 4,997,307

[45] Date of Patent: Mar. 5, 1991

[54] REMOVABLE SNOW POLE INSERT

[76] Inventor: Donald W. Schmanski, 1301 Hot Springs Rd., Carson City, Nev. 89706

[21] Appl. No.: 441,254

[22] Filed: Nov. 27, 1989

[51] Int. Cl.[5] ..... E01F 9/00

[52] U.S. Cl. ..... 404/10; 256/1; 403/372

[58] Field of Search ..... 256/1; 404/10, 9; 403/372

[56] References Cited

U.S. PATENT DOCUMENTS 4,629,078 12/1986 Korth ..... 403/372 X 4,636,106 1/1987 Waisbrod ..... 403/372 X

FOREIGN PATENT DOCUMENTS 1170948 11/1969 United Kingdom ..... 404/10

*Primary Examiner*—Andrew V. Kundrat

*Attorney, Agent, or Firm*—Thorpe, North & Western

[57] ABSTRACT

A snow pole extension device for attachment to road side delineators wherein at least a section of the delineator includes a tubular cross section and opening having a substantially uniform geometric configuration. The device includes an insert coupling for attachment to a base end of the snow pole to facilitate its insertion within the tubular opening of the delineator. This insert coupling is configured as a sleeve member having a tubular opening similar in geometric configuration with the external configuration of the snow pole to facilitate snug, friction fit attachment. The sleeve member is formed with an exterior configuration and dimension sufficiently small to enable insertion and retention of the sleeve member therein by means of a tight, frictional fit.

20 Claims, 1 Drawing Sheet

REMOVABLE SNOW POLE INSERT

BACKGROUND OF THE INVENTION

1. Field of Invention:

The present invention relates to snow poles which can be installed in connection with an existing delineator along a road side, particularly where snow accumulations can exceed the height of the delineator and thereby obscure its vision.

More specifically, the present invention relates to removable snow poles which can be installed or withdrawn in accordance with the seasons.

2. Prior Art:

Highway delineation devices are an integral part of virtually every well-traveled roadway. This is particularly true at curved sections of the road where night receptors mounted to delineators provide advance warning to motorists of a change of direction.

The most common delineator device on the open highway is generally referred to as a "hat-section" post. This name was acquired by its association with the hat-like cross-section of the post, as is illustrated in FIGS. 1 and 3. The post is typically fabricated of steel and includes two side walls 10 and 11, each having a mounting flange 12 and 13 to facilitate attachment of a reflector plate 14. These respective side walls 10 and 11 and flanges 12 and 13 resemble a side view of a hat, with the top of the hat being formed by the back plate 15. The interior of the hat would be comparable to the channel 16 formed between side walls 10 and 11.

These delineators vary in length from five to seven feet and are positioned along the road side at a height of approximately four to five feet above ground level. The reflective plate 14 may extend from three to 12 inches in length, defining a tubular enclosure **16*a* formed in combination with the channel 16. The channel configuration for the hat-section post closely resembles a trapezoid with side walls 10 and 11 and primary and secondary bases formed by reflector plate 14 and back plate 15. The elevation of the reflector plate 14** at approximately four feet provides correct angular orientation with respect to headlight reflection for night travelers.

During winter seasons, snow accumulations may exceed the height of the delineator and thereby obscure both day and night view of the delineator structure. Such snow accumulation may be by natural snowfall or snow drifting, or may be piled along the road side by snow plows during normal operation. In any event, concealment of the subject delineation devices poses extreme hazards to the driver, particularly at night.

Accordingly, it has been common practice to attach a snow pole extension to give added height to the delineator. Typically, this is done by utilizing a slat or rod which is somehow anchored to the existing delineator (such as the hat section of FIG. 1). This rod may extend to any desired height above the delineator, depending upon expected snow accumulation. Methods of attaching the snow pole to the delineator have varied from merely inserting of the rod or strap into the tubular opening **16*a*** and extending channel in a "free-moving" manner, or by bolting or wiring the snow pole to the delineator body for more secure positioning.

These respective methods each have disadvantages which represent increased expense in connection with maintenance of a snow pole system. For example, utilization of a strap bolted to the delineator body is labor intensive, requiring significant effort to insert and tighten bolts through properly aligned holes in the snow pole and delineator. Also, vibration in the strap body arising from constant wind buffeting causes the strap to wear and fail at the bolted location. When one considers the hundreds of thousands of delineators which require snow pole extensions, the extreme cost of making such modifications or affecting repair becomes significant. In contrast, if the snow pole is merely inserted in free-moving manner, it is easily stolen, or may be knocked free by action of a snow plow, wind or incidental contact with projecting objects from trucks and other vehicles. Finally, and most important, public safety demands that the risk of injury or loss of human life be minimized by proper delineation. Accordingly, the seriousness of maintaining effective delineation despite snow accumulation and/or removal becomes even more serious.

OBJECTS AND SUMMARY OF THE INVENTION

It is therefor an object of the present invention to provide an improved snow pole extension which enhances survivability of the snow pole despite adverse conditions.

A further object of the present invention is to provide an improved snow pole extension which can be quickly inserted or withdrawn, thereby reducing labor costs.

A further object of this invention is to facilitate installation of a snow pole extension by means which discourage vandalism and theft.

A still further object of the present invention is to provide a device which may be attached to existing snow poles to facilitate their insertion with respect to existing delineators.

These and other objects are realized with a snow pole extension device which comprises a coupling device attachable to the base of a snow pole to facilitate a friction-fit insertion within the tubular cross section and opening of an existing delineator. This coupling device includes a tubular sleeve member which has a tubular opening suited for attachment around the base of the snow pole extension. This tubular opening has a corresponding geometric configuration similar to the external configuration of the snow pole to which it is to be attached. Its dimensions and size are structured to provide a friction fit for the sleeve as a base attachment device around the external configuration of the snow pole base. At the same time, the exterior configuration of the sleeve is slightly oversized as compared to the delineator tubular cross-section and tubular opening to fit snugly but removably therein, while being sufficiently small to enable friction fit of the sleeve member within the tubular opening of the delineator.

Other objects and features of the present invention will be apparent to those skilled in the art in view of the following detailed description, taken in combination with the accompanying drawings.

DETAILED DESCRIPTION OF THE INVENTION

Figure 1:
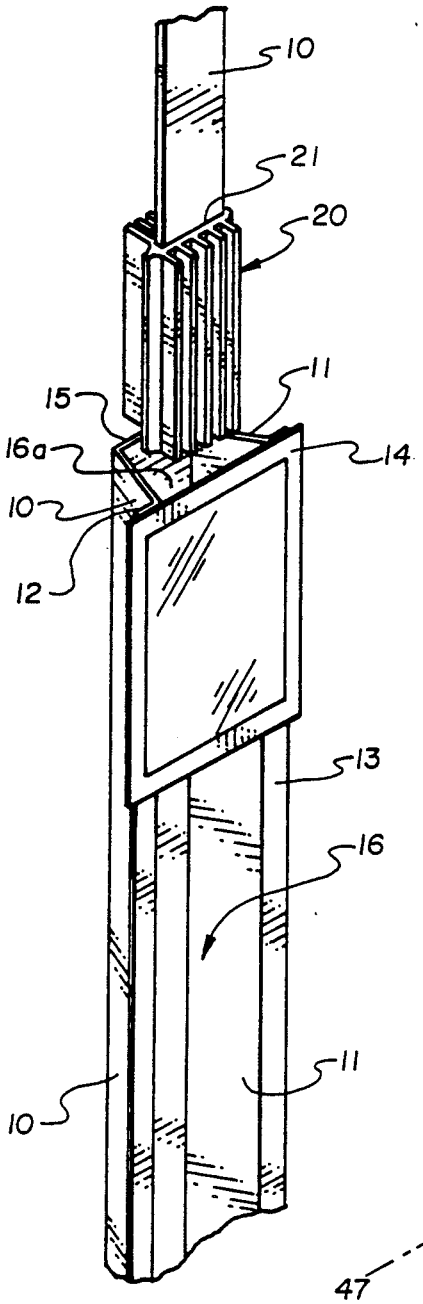
FIG. 1 shows a perspective view of a prior art delineator of hat-section design, with a modified snow pole in a superior position for insertion within and attachment to the delineator.

FIG. 1 shows a conventional hat-section post described in the prior art section of this disclosure, with a snow pole 10 prepared for insertion within the tubular cross section 16*a* of the delineator. The snow pole 10 has been modified by use of an insert coupling device 20 which has been attached to a base end of the snow pole 10. As is common to both the snow pole and delineator construction, the respective dimensions are uniform along the pole or post length. The upper end of the snow pole (not shown) is adapted for giving visual delineation of the roadway which may otherwise be concealed under snow. The lower end (illustrated in FIG. 1 as item 10) should be of sufficient strength to support attachment of the upper end of the snow pole to the roadside delineator.

Figure 3:
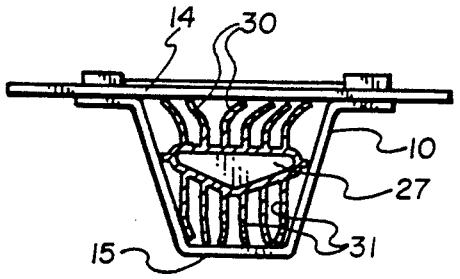
FIG. 3 illustrates a top end view of the coupling device in its attached and inserted configuration with respect to a hat-section delineator post.

The coupling device 20 includes a sleeve member having a tubular body configured (i) at an interior face 21 for a frictional fit around the body of the snow pole 10. The exterior surface or perimeter of the sleeve 20 is configured and dimensioned to fit snugly but removably within the tubular cross section and opening 16*a* of the delineator, such as is illustrated in FIG. 3. In a preferred embodiment such as illustrated in FIG. 1, the tubular opening 21 has a corresponding geometric configuration with the external configuration of the snow pole to which it is attached. The dimensions of the tubular opening when positioned within the delineator should be no greater in size than the external configuration of the snow pole to insure a snug, friction-tight fit.

Figure 2:
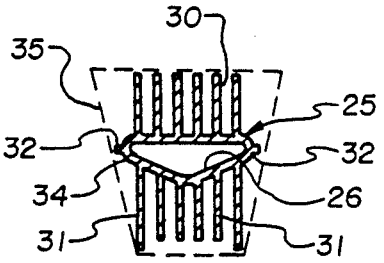
FIG. 2 shows an end view of a coupling device which facilitates the attachment of the snow pole to the delineator.

It will be apparent from the drawings that a variety of snow pole configurations can be adapted with the present invention. For example, FIG. 1 illustrates a snow pole configured as a slat with rectangular cross section. The sleeve member may be a flexible, elastic form of material which conforms to take the shape of the snow pole body. FIGS. 2 and 3 illustrate a sleeve member 25 which is geometrically configured at its tubular opening 26 to conform to a snow pole slat 27 of triangular cross section. Additional embodiments are illustrated in FIGS. 4 and 5, depicting a round 42 or oval type of snow pole, as well as a snow pole of general "T" cross section 43.

Figure 4:
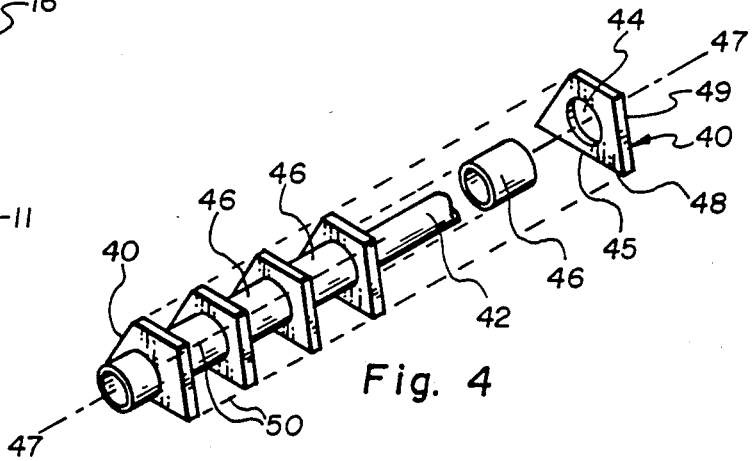
FIG. 4 shows an alternate embodiment of a coupling device for attaching a round snow pole to a hat-section delineator post.
Figure 5:
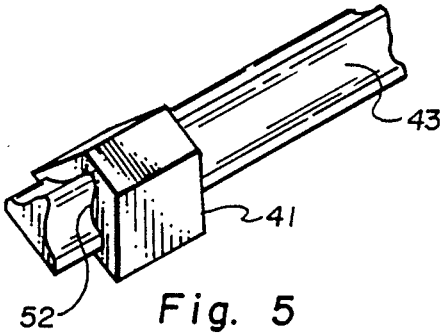
FIG. 5 shows yet another embodiment for enabling attachment of a T-shaped snow pole with respect to a hat-section delineator post.

The tubular sleeve members 40 illustrated in FIG. 4 are structured as tabs which slide over the snow pole 32 and 43. As illustrated in FIG. 4, each tab has a tubular opening 44 having a corresponding geometric configuration with the external configuration of the snow pole 42. A tubular sleeve 41 is shown in FIG. 5 and represents a foam rubber construction which is capable of being compressed within the delineator channel 16*a* for an enhanced frictional fit. These sleeve members 40, 41 are further configured with an exterior configuration (represented by perimeter 45) which matches the configuration of the tubular opening 16*a* within the delineator body. The sleeve member exterior configuration 45 has dimensions when positioned within the delineator which are no less in size than the configuration of the tubular opening 16*a*, but sufficiently small to enable snug insertion of the sleeve member 40 within the tubular opening 16*a* of the delineator. In this case, the external configuration is that of a trapezoid. Whereas FIG. 5 illustrates a tubular sleeve 41 with a tight friction fit over the snow pole body 43, FIG. 4 illustrates the use of spacer elements 46. These spacer elements 46 slide telescopically over the snow pole 42 and prevent displacement of tab elements 40 which also slide over the snow pole body 42 in alternating fashion.

In the tab embodiment of the present coupling device, each tab element includes opposing tab faces 48 and 49, a perimeter edge 45 defining the exterior surface as previously mentioned, and a tubular opening 44 formed along an axis 47 which is parallel or common with the axis of the snow pole 42. This axis is approximately perpendicular to the tab faces 48 and 49 and facilitates use of a plurality of such tabs to form an exterior contacting surface 50 corresponding to the tubular opening 16*a* of the delineator.

In use, the snow pole structure of FIG. 4 would be oriented in a manner similar to that orientation in FIG. 1 for snow pole 10. In this instance, the plurality of tab members 40 would fit snugly within the tubular enclosure 16*a* by virtue of corresponding trapezoidal shape. Tab elements 40 of FIG. 4 are formed of flexible polymer material and are of slightly larger dimension at their respective perimeters 45 such that the tab is forced to deflect within the tubular enclosure 16*a* for a tight, frictional fit. By shortening the spacer 46 between the respective tabs 40, increased surface area and frictional contact can be provided.

In contrast with the solid core design of FIGS. 4 and 5, FIGS. 1, 2 and 3 illustrate the use of vertical flange elements to provide the desired frictional fit. In this embodiment, the sleeve member includes outward projecting flange elements 30, 31 and 32. These are respectively coupled at their proximal ends to the sleeve body 34. These flanges are structured in size and length to provide location of their distal sides in close proximity to an imaginary geometric configuration 35 which corresponds with the cross sectional opening of the delineator 16*a*. This exterior surface configuration 35 is slightly oversized as compared to the delineator tubular opening 16*a* to thereby flex the flange elements 30 into compression upon forced insertion into the tubular opening as illustrated in FIG. 3. This provides a tight, frictional fit between the snow pole and the delineator body. Snow pole 27 and delineator body 10. As is illustrated in FIGS. 2 and 3, the respective flanges 30 and 31 are spaced apart to allow sufficient distance for each flange to collapse in frictional contact with a portion of the interior tubular opening of the delineator. Generally, these will be spaced apart such that their respective collapse does not result in substantial contact with adjacent flange elements. This leaves some room for further flexing to enable the twist and withdrawal of the snow pole from within the delineator when risk of snow fall has passed.

The specific embodiment illustrated in FIGS. 1, 2 and 3 for the sleeve member orient the primary flanges 30 and 31 in forward and rearward directions. This imposes most of the frictional contact on the front plate 14 and rear plate 15. Lateral flanges 32 are of only minimal size and operate primarily to maintain orientation of the front and rearward flanges 30 and 31. By decreasing the distance between flange elements and by increasing the number of flanges, greater frictional contact can be established, providing more secure attachment of the snow pole.

Typically, the length of the sleeve 20 will extend the full length of the reflector plate 14. This may range from as much as three inches on smaller plates to almost a foot for longer plate configurations. In some cases, as with the sleeve of FIG. 5, it may be positioned within the delineator opening 16*a* such that the sleeve opening 52 allows insertion and removal of the snow pole as needed without removal of the coupling device.

Numerous advantages arise by virtue of application of the present inventive concepts. For example, the use of flexible flanges and flanges 30 and 31, and flexible tabs 40 and 41 provide resilience to the snow pole. Therefore, upon impact by snow from a snow plow or objects extending from vehicles, the snow pole cushioned and spaced from the steel delineator wall and is less likely to shear. The coupling device also tends to reposition itself with the pole in upright orientation. Vibrational energy is absorbed in the coupling device, thereby reducing wear. The present construction permits rapid insertion with a forceful push, and permits withdrawal of the device by twisting and pulling the pole free.

The device enables use of existing configurations for not only hat-section posts but other geometries as well. Furthermore, the same snow poles which have been applied by prior art techniques may now be modified by attachment of the described sleeve or coupling device to the base. Therefore, existing snow poles can be mounted in existing delineators without the need for additional capital investment beyond purchase of a coupling device.

It will be apparent to those skilled in the art that other modifications and variations can be developed in connection with the present inventive principles. It is therefore to be understood that the scope of the present invention is not to be limited by way of examples previously set forth, but only by the following claims.

I claim:

1. A snow pole extension device for use with roadside delineators wherein at least a section of the delineator includes a tubular cross-section and opening having a uniform geometric configuration, said device comprising:

1.1 a snow pole having (i) an upper end adapted for giving visual delineation of a roadway which may be otherwise concealed under snow and (ii) a lower end having sufficient strength to support attachment to an upper end of the roadside delineator;

1.2 a sleeve member having a tubular body and opening configured (i) at an interior face for a tight, friction fit around the lower end of the snow pole to retain a fixed position which resists movement with respect to the snow pole and (ii) at an exterior surface with a slightly oversized configuration as compared to the delineator tubular cross-section and opening and dimensioned to fit snugly but removably within the tubular cross-section and opening, said sleeve being coupled to the lower end of the snow pole.

2. A snow pole device as defined in claim 1, wherein the snow pole comprises a rod and has a round cross-sectional configuration, said sleeve member having a corresponding round tubular opening.

3. A snow pole device as defined in claim 1, wherein the snow pole comprises a rectangular slat and has a rectangularly shaped cross-sectional configuration, said sleeve member having a corresponding rectangularly shaped tubular opening.

4. A snow pole device as defined in claim 1, wherein the snow pole comprises a triangular slat and has a triangularly shaped cross-sectional configuration, said sleeve member having a corresponding triangularly shaped tubular opening.

5. A snow pole device as defined in claim 1, wherein the delineator has a hat-section configuration with a trapezoidally shaped tubular cross-sectional opening, said sleeve member having an exterior surface configuration of corresponding trapezoidal shape for insertion within the tubular cross-section of the delineator.

6. A snow pole device as defined in claim 5, said sleeve member including outward projecting flange elements coupled to the sleeve body at a proximal edge and wherein the exterior surface configuration is approximately represented by imaginary lines connecting adjacent distal sides of the flange elements, said exterior surface configuration having a slightly oversized configuration as compared to the delineator tubular opening to thereby flex the flange elements into compression upon forced insertion into the tubular opening to establish a friction fit of the snow pole to the delineator.

7. A snow pole device as defined in claim 6, wherein the flange elements are spaced apart a sufficient distance to allow the partial collapse of the flange elements with incurring substantial contact with adjacent flange elements.

8. A snow pole device as defined in claim 7, wherein the flange elements project generally in forward and rearward directions for primary contact with parallel sides of the trapezoidal cross-section.

9. A snow pole device as defined in claim 1, wherein the sleeve member has an axial length extending parallel with the axial length of the snow pole for a distance of at least three inches.

10. A snow pole device as defined in claim 9, wherein the sleeve member has an axial length extending parallel with the axial length of the snow pole for a distance equal to the length of the tubular section of the delineator.

11. A snow pole device as defined in claim 1, wherein the sleeve member comprises a plurality of tab elements having opposing tab faces, a perimeter edge defining the exterior surface described in claim 1 and a tubular opening formed along an axis approximately perpendicular to the tab faces, said tab being inserted over the snow pole through the tubular opening to form an exterior sleeve having an exterior surface defined by the perimeter edge of the tab.

12. A snow pole device as defined in claim 11, further comprising a plurality of tabs of common geometric configuration and size and being mounted upon the snow pole in spaced apart configuration.

13. A snow pole device as defined in claim 12, further comprising a spacer element between each tab to maintain proper spacing of the tabs on the snow pole.

14. An insert coupling device for use with a snow pole to enable removable attachment of the snow pole to a delineator which includes a tubular cross-section and opening of uniform geometric configuration, said device comprising a sleeve member having:

14.1 a tubular body and tubular opening, said tubular opening having a corresponding geometric configuration similar with the external configuration of the snow pole to which it is to be attached and with dimensions which provide a tight, friction fit around the external configuration of the snow pole to retain a fixed position which resists movement with respect to the snow pole when positioned in the delineator; and 14.2 said tubular body being configured with an oversized exterior configuration and dimension as compared to the delineator tubular cross-section and opening yet being sufficiently small to enable insertion and retention of the sleeve member within the tubular opening of the delineator based on a snug, frictional fit.

15. An insert coupling device as defined in claim 14, wherein the device is configured for insertion within a delineator having a hat-section configuration with a trapezoidally shaped tubular cross-sectional opening, said sleeve member having an exterior surface configuration of corresponding trapezoidal shape for insertion within the tubular cross-section of the delineator.

16. An insert coupling device as defined in claim 15, said sleeve member including outward projecting, flexible flange elements coupled to the sleeve body at a proximal edge and wherein the exterior surface configuration is approximately represented by imaginary lines connecting adjacent distal sides of the flange elements, said exterior surface configuration having a slightly oversized configuration as compared to the delineator tubular opening to thereby flex the flange elements into compression upon forced insertion into the tubular opening to establish a friction fit of the snow pole to the delineator.

17. An insert coupling device as defined in claim 16, wherein the flange elements are spaced apart a sufficient distance to allow the partial collapse of the flange elements with incurring substantial contact with adjacent flange elements.

18. An insert coupling device as defined in claim 14, wherein the sleeve member comprises a plurality of tab elements having opposing tab faces, a perimeter edge defining the exterior surface described in claim 14 and a tubular opening formed along an axis approximately perpendicular to the tab faces, each tab being configured for insertion over the snow pole through the tubular opening to collectively form an exterior sleeve having an exterior surface defined by the collective perimeter edges of the tabs.

19. An insert coupling device as defined in claim 15, wherein the tubular body is constructed of foamed rubber which is capable of being compressed to a smaller volume upon insertion into the delineator tubular opening.

20. An insert coupling device as defined in claim 15, wherein the tubular body is constructed of foamed polymer which is capable of being compressed to a smaller volume upon insertion into the delineator tubular opening.

* * * * *